United States Patent [19]

Jean

[11] 4,201,233

[45] May 6, 1980

[54] CIGARETTE RETARDING AND SNUFFING DEVICE

[76] Inventor: Albert L. Jean, 49 Merrimack Ter., Dracut, Mass. 01826

[21] Appl. No.: 863,227

[22] Filed: Dec. 22, 1977

[51] Int. Cl.[2] ..... A24F 13/18; A24F 19/14

[52] U.S. Cl. ..... 131/237; 131/240 E

[58] Field of Search ..... 131/235 R, 237, 231, 131/240, 240 E

[56] References Cited

U.S. PATENT DOCUMENTS

| | | | |
|---|---|---|---|
| 1,889,801 | 12/1932 | Bessmer | 131/235 R |
| 2,231,776 | 2/1941 | Seelinger | 131/235 R |
| 2,768,631 | 10/1956 | Russell | 131/235 R |
| 2,936,765 | 5/1960 | Talkington | 131/235 R |
| 3,491,773 | 1/1970 | Herbert | 131/235 R |

*Primary Examiner*—Stephen C. Pellegrino
*Attorney, Agent, or Firm*—Pearson & Pearson

[57] ABSTRACT

A cigarette holder is supported on a framework which is detachably mounted in an ashtray. The holder is an elongated, hollow, cylindrical tube, mounted substantially vertically above the ashtray and having an open upper end and an open lower end. To extinguish combustion the upper end of a counterweighted pivoted arm halts advance of a cigarette within the lower end of the tube. The arm tip is selectively movable from snuffing position in the tube, to retarding position below the tube to inactive position. To retard combustion an annular, circular flange may also extend inwardly around the open lower end to restrain the cigarette paper while the protruding tip burns slowly.

4 Claims, 7 Drawing Figures

Fig. 2.
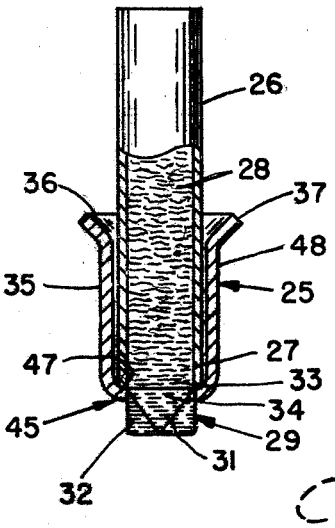
Fig. 3.
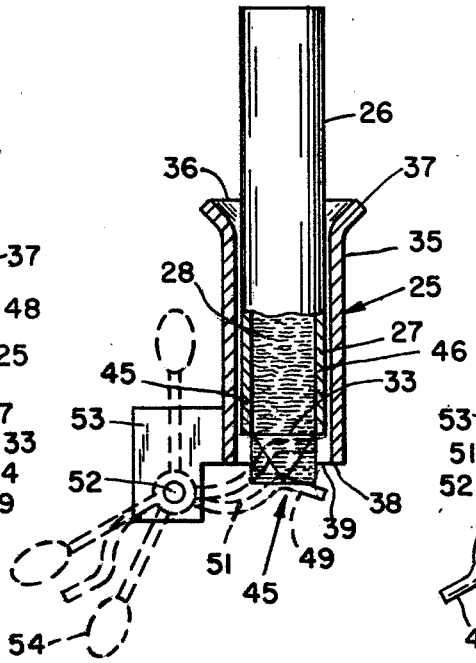
Fig. 6.
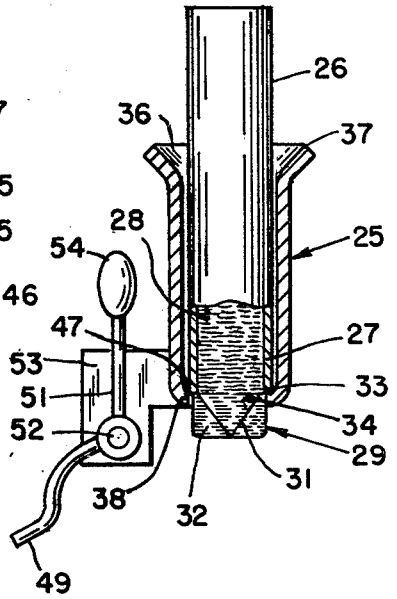
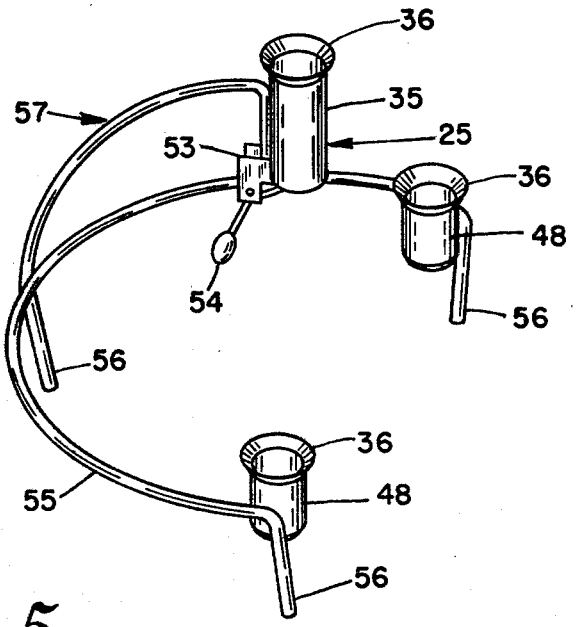
Fig. 5.
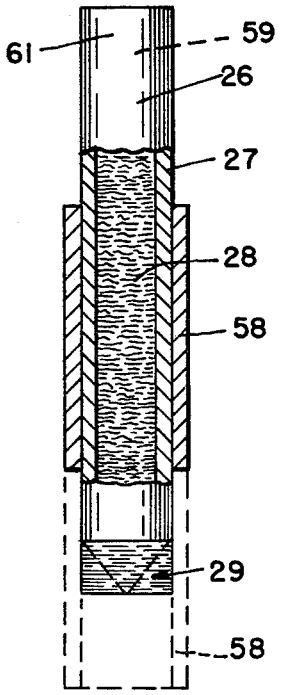
Fig. 7.

CIGARETTE RETARDING AND SNUFFING DEVICE

BACKGROUND OF THE INVENTION

Ashtrays have heretofore been proposed in which there are dead end holes in which the lighted tip of a cigarette may be extinguished.

It has also been proposed to provide open ended tubes attachable to an ashtray and in which the lighted tip of a cigarette is extinguished for lack of oxygen and the dead butt then pushed out by the next cigarette.

Exemplary of such a vertical tapered tube is that shown in U.S. Pat. No. 3,486,509 to Menold of Dec. 30, 1969, while generally horizontal such tubes are disclosed in U.S. Pat. No. 2,171,489 to Cameron of Aug. 29, 1939 and U.S. Pat. No. 2,768,631 to Russell of Oct. 30, 1956.

It has further been proposed to provide open ended tubes attachable to an ashtray and which hold the cigarette with the lighted end protruding from the lower end of the tube to retard combustion without extinguishing the same.

In U.S. Pat. No. 1,725,196 to Johnson of Aug. 20, 1929, the lighted tip of a cigarette inserted in a tubular orifice protrudes therefrom to engage a wall of another passage and thereby delay extinguishment. Similarly in U.S. Pat. No. 1,776,563 to MaCready of Sept. 23, 1930, a hooked arm, or foot, supports the protruding lighted end of a cigarette in a tube to enable the cigarette to burn slowly until the lighted part reaches into the tube for extinguishment due to lack of air.

SUMMARY OF THE INVENTION

In this invention an elongated hollow cylindrical, open ended tube is sued and it is detachably mounted within an ashtray on a skeletonized framework.

The substantially vertical tube may include an annular flange extending inwardly entirely around the open lower end of the tube to seat and restrain only the leading edge of the cigarette paper. Thus the lighted end protrudes below the level of the lower end of the tube for slow combustion in the ambient atmosphere for about one minute. It will then extinguish itself within the tube unless the cigarette is removed for further smoking.

In addition, or alternatively, when immediate extinguishment of the lighted end of a cigarette is desired, an arm is pivoted on a bracket affixed to the tube, one end of the arm being normally within the lower end of the tube and the other end of the arm carrying a counterweight.

Upon insertion of a cigarette in the tube, the lighted end engages the arm within the tube and since there is no oxygen, the tip is extinguished. Finger pressure will then push the cigarette butt out of the tube while pivoting the arm out of the path. If desired the arm may be so counterweighted that a partially consumed cigarette is heavy enough to pivot the arm tip downwardly to support the lighted end in position protruding into the atmosphere with the edge of the cigarette paper about level with the rim of the lower end. When the cigarette is consumed to a short lighted butt it will be of less weight and ready for extinguishment so that the counterweight will move to its lower position, raising the tip up well within the tube to extinguish the butt. It can then be easily pushed out of the tube into the ash tray, or if there is an internal flange the butt can be pushed out, but only with the exertion of greater finger pressure.

If not required for use the arm may be reversed, with the counterweight at the top, and the tip at the other end out of the path of cigarettes in the tube.

BRIEF DESCRIPTION OF THE DRAWING

FIG. 2 is an enlarged side elevation in half section of the cigarette holder tube retarding combustion;

FIG. 3 is a view similar to FIG. 2 showing the cigarette holder tube extinguishing combustion;

FIG. 5 is a perspective view on a reduced scale showing a cigarette holder adjustable to ashtrays of different dimensions;

FIG. 6 is a view similar to FIG. 3 showing the counterweighted retarder arm in inoperative position; and FIG. 7 is a view similar to FIG. 2 of another embodiment of the invention.

DESCRIPTION OF A PREFERRED EMBODIMENT

Figure 1:
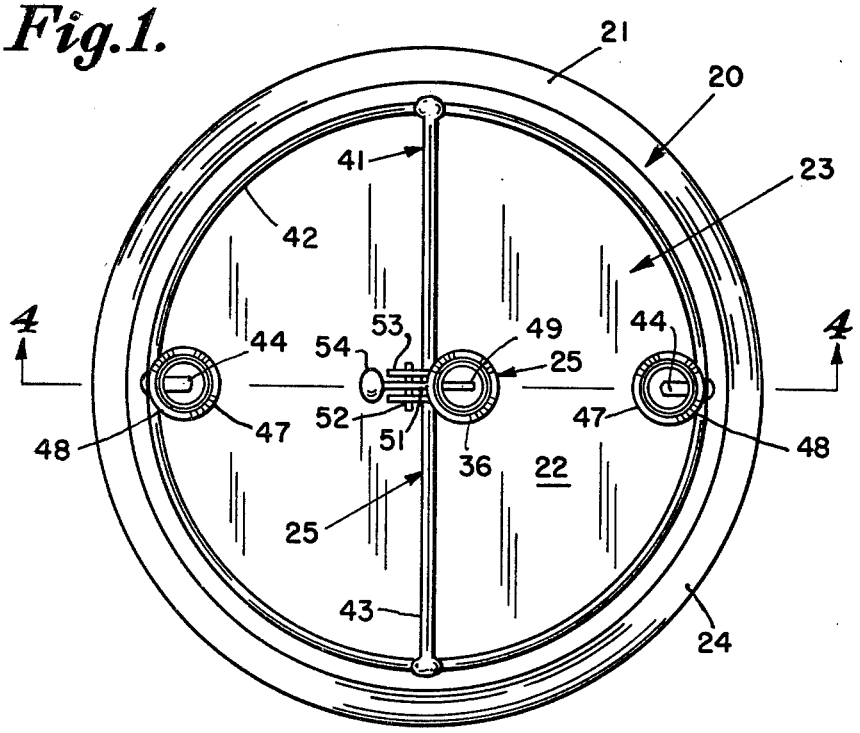
FIG. 1 is a plan view of a cigarette holder of the invention detachably mounted in an ashtray.

As shown in the drawing a typical ashtray 20 includes an upstanding side wall 21, a bottom 22 and an opening 23 at the top, all forming a receptacle 24 for cigarette butts and the like.

The device 25 of the invention is for use with cigarette 26 which comprises a cigarette paper 27 of uniform outside diameter, tobacco filling 28 and which may have a lighted end, or tip, 29. Tip 29 while appearing cylindrical is actually composed of a truncated conical solid portion 31 surrounded by soft ash 32. Thus the rim, or lower edge 33 of the paper, and the centre 34 of the lighted tip have solidity and integrity sufficient to restrain or support the cigarette in the tube but the cylindrical ash 32 does not.

The cigarette holder device 25 includes an elongated hollow tube 35, which is preferably cylindrical with an open, upper end 36 having an outward flare 37 and having an open lower end 38. The tube 35 is formed of thin metal such as copper, or similar fireproof material and the circular, peripheral lower edge 39 is at a level at a spaced distance from the bottom 22 of the ashtray such as about one inch or more.

Figure 4:
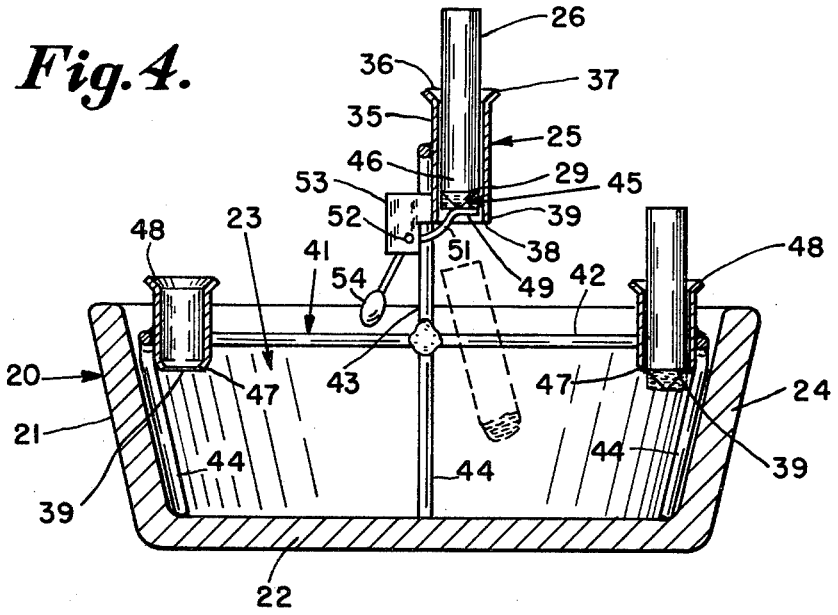
FIG. 4 is a side elevation of the device of FIG. 1 in section on line 4—4.

As shown in FIGS. 1 and 4 a skeletonized framework 41 of metal wire, such as copper, or other suitable material, is preferably a part of the holder 25 and forms the means for detachably supporting one or more tubes substantially vertically above the bottom of the ashtray.

In the embodiment shown in FIGS. 1 and 4, the framework 41 has an arcuate, horizontal, frame member 42 of full circular configuration, brazed, or welded to an upstanding arcuate member 43, there being four integral, legs such as 44, extending from the member 42 down to the ashtray bottom 22. The horizontal circular member 42 extends around the inside of the upstanding side wall 21 of the ashtray 20 and the legs 44 extend down the inside thereof also.

Each tube 35 is provided with means 45 normally within the interior 46 of the tube proximate the leve of the open lower end 38 for supporting a cigarette 26 with only its lighted tip 29 protruding out of the lower end into the ambient atmosphere.

Means 45 may be an integral, annular, circular flange 47 extending entirely around the rim, or lower edge, 39 of the open lower end 38 of tube 35, the flange 47 having an inner diameter slightly less than the outside diameter of the cigarette 26. Thus when a lighted cigarette, which is normally about 12/32 of an inch in outside diameter, is inserted in the tube 35, of about 13/32 of an inch, in inside diameter, there will be a total clearance of 1/32 of an inch, or 1/64 of an inch on each side of the cigarette. The flange 47 forms a seat about 1/64 inches wide in the path of the edge 33 of the paper 27 of the cigarette 26, to support that edge just within the interior 46 while the lighted tip 29 protrudes into the atmosphere. The tip will continue burning for about one minute until it reaches the level of the open lower end 38 whereupon it will extinguish for lack of oxygen. The dead butt can be pushed down out of the tube by finger pressure or it may be lifted out of the tube and deposited in the ashtray receptacle 24.

A flange 47 of the invention is shown in the retarding tubes 48 on each opposite side of the framework 41 in FIGS. 1 and 4 and is shown enlarged in FIG. 2.

Means 45 preferably however is the free terminal tip 49 of an arm 51 pivoted at 52 in a bracket 53 affixed to the tube and having a counterweight 54 at the opposite free terminal end. The counterweight 54 normally lifts the tip 49 up well within the interior 46 of the tube 35 so that the lighted tip 29 of a cigarette 26 is barred from advance and caused to be extinguished for lack of oxygen. Finger pressure on the dead butt will overcome the resistance of the counterweight to move the tip 49 downwardly out of the path and permit the butt to fall into the receptacle. As shown in the drawings the arm 51 is of wire, or rod, like material and dimensioned so that when the tip 49 is within the interior 46 of the tube it is spaced from the wall of the tube to engage and support the centre 34 of the lighted tip 29 of a cigarette 26.

As shown in dotted lines in FIG. 3 while a relatively short cigarette butt will be extinguished by the tip 49 being up within the tube, a longer lighted cigarette intended to be only retarded in combustion and not extinguished will be heavier and will pivot the counterweight sufficiently to locate the tip 49 at a level which will permit the lighted tip 29 to protrude for slow combusion for about one minute. The lighted tip will then reach the interior of the tube and be extinguished if the cigarette is not withdrawn for another puff.

As shown in full ines in FIG. 6, the counterweight may be pivoted upwardly until it will remain in upward position within the bracket until needed. The annular flange 47 then serves as the combustion retarder, to expose the lighted tip to the ambient atmosphere until combustion reaches the interior of the tube.

As shown in FIG. 5 the cigarette holder 25 may be structured to fit ashtrays of any areas by providing a horizontal member 55 which extends angularly at least 190° but is not a circle, there being three legs 56 and an arcuate upstanding member 57 extending only 90° angularly. The bendable wire member 55 may be extended or contracted with ease to fit any size ashtray.

In FIG. 7 a cigarette 26 having a cigarette paper 27 of predetermined, uniform, outside diameter, such as 12/32 of an inch and of predetermined length is sleeved within an elongated, hollow cylindrical tube 58 of predetermined, uniform inside diameter about 12/32 of an inch diameter, so as to remain in place by friction but to be slidable along the cigarette with slight resistance.

The tube, or cylinder, 58 is preferably of paper and of less length than the cigarette, for example about three quarters of an inch in length. It is normally positioned one half inch from the mouthpiece end 59 of the cigarette. The paper or tube 58 is the same texture as that of the paper 61 enveloping the filter of a filtered cigarette and is placed on the cigarette by the manufacturer in a snug fashion so that it will slide, but not freely.

In operation the cigarette is held by the mouthpiece 59 and the paper cylinder 58 is slid forwardly until it covers the ashes of the burning tip 29 to extinguish the same in about four to five seconds.

Thus concern as to whether a cigarette is extinguished or smouldering is eliminated, no tar is built up in ash trays from snuffing out cigarettes therein, and, if necessary, a lighted cigarette can be safely placed in the pocket with the tube 58 in the extinguishing position shown in dotted lines.

I claim:

1. A combined ashtray and cigarette holder comprising an ash receptacle having a bottom and an upstanding side wall;

an elongated tube having a generally cylinderical wall of predetermined inside diameter slightly greater than the diameter of a cigarette, an outwardly flared open upper end and an open lower end; and an arm centrally pivoted on said tube proximate the open lower end thereof, said arm having a counter weight at one end, and said arm having a pin like tip at the other end normally located within the open lower end of said tube and spaced from the wall thereof said arm tip being selectively movable from cigarette snuffing position within said tube, to cigarette combustion retarding position just below said open lower end to inactive position far removed from said lower end.

2. A combined ashtray and cigarette holder as specified in claim 1 wherein:

said cylindrical wall of said tube includes an integral inward projecting annular rim of predetermined dimensions such as to intercept and bar the advance of the cigarette paper of a cigarette but defining an opening equal in diameter to the diameter of the tobacco filler of a cigarette.

3. A cigarette extinguisher comprising:

a hollow tube having a generally cylinderical wall with an open lower end;

an arm of wire-like material centrally pivoted to said tube proximate said open lower end;

said arm having a counterweight at one end and a tip at the other end;

said tip being normally located in the centre of the interior of the lower end portion of said tube, at a spaced distance from the wall thereof, to engage and support the centre of the lighted tip of a cigarette in said tube;

said counter weight being so balanced relative to the weight of a cigarette as to locate said tip within said tube when a cigarette is nearly consumed and therefore relatively light to snuff the same;

but to locate said tip just below the open lower end of said tube, with the lighted end of the cigarette outside said tube, when a cigarette is only partially consumed and therefore relatively heavy to retard combustion thereof.

4. A combined snuffer and retarder for cigarettes comprising an upstanding hollow tube adapted to have a cigarette sleeved therein and an elongated snuffer and retarder member, pivoted centrally thereof at the lower end of said tube;

said pivoted member having a counterweight at one terminal end and having an opposite terminal end normally located in the centre of the lower end of said tube to support the centre of the lighted tip of a cigarette for snuffing the same, said one terminal end, and said arm, being freely pivotable out of the path of an extinguished cigarette being discharged out of the lower end of said tube and then pivoting back to said normal position with said tip within said tube.

* * * * *